US009797683B2

(12) United States Patent
Tang

(10) Patent No.: US 9,797,683 B2
(45) Date of Patent: Oct. 24, 2017

(54) SIGHT

(71) Applicants: Sintai Optical (Shenzhen) Co., Ltd., Taichung (TW); Asia Optical International Ltd., Taichung (TW)

(72) Inventor: Chia-Chi Tang, Taichung (TW)

(73) Assignees: SINTAI OPTICAL (SHENZHEN) CO., LTD., Taichung (TW); ASIA OPTICAL INTERNATIONAL LTD., Taichung (TW)

( * ) Notice: Subject to any disclaimer, the term of this patent is extended or adjusted under 35 U.S.C. 154(b) by 0 days.

(21) Appl. No.: 14/998,999

(22) Filed: Mar. 15, 2016

(65) Prior Publication Data

US 2016/0290763 A1 Oct. 6, 2016

(30) Foreign Application Priority Data

Apr. 1, 2015 (CN) ..... 2015 1 0152876

(51) Int. Cl.
*F41G 1/38* (2006.01)

(52) U.S. Cl.
CPC ..... *F41G 1/38* (2013.01)

(58) Field of Classification Search
CPC ..... F41G 1/38
See application file for complete search history.

(56) References Cited

U.S. PATENT DOCUMENTS 3,161,716 A * 12/1964 Burris ..... G02B 23/145 356/247
3,506,330 A * 4/1970 Allen ..... F41G 1/38 356/21
4,789,231 A * 12/1988 Shimizu ..... F41G 1/38 359/422
5,363,559 A 11/1994 McCarty
5,499,456 A 3/1996 Tomita
5,771,595 A * 6/1998 Bell ..... G02B 23/14 42/122
7,684,114 B2 * 3/2010 Thomas ..... F41G 1/38 359/421
2006/0168871 A1 * 8/2006 Wagner ..... F41G 1/38 42/122
2014/0347751 A1 * 11/2014 Tang ..... G02B 23/16 359/819

* cited by examiner

*Primary Examiner* — Stephen Johnson
*Assistant Examiner* — Joshua T Semick
(74) *Attorney, Agent, or Firm* — McClure, Qualey & Rodack, LLP

(57) ABSTRACT

A sight includes an adjusting module, a collector ring, a first adjusting element, and an elastic element. The collector ring includes a connecting end connected to the adjusting module, a free end opposite to the connecting end, a periphery connecting the connecting end and the free end, and a notch formed on the periphery and connected to the free end. The first adjusting element includes a first end which abuts the periphery. The elastic element extends in a direction from the free end to the connecting end and abuts the periphery. The elastic element contacts the periphery in a position between the notch and the connecting end. The first end is configured to resist an elastic force exerted by the elastic element and move the collector ring.

11 Claims, 8 Drawing Sheets

SIGHT

BACKGROUND OF THE INVENTION

Field of the Invention

The invention relates to a sight for weapons, and more particularly to a sight capable of providing a larger range of compensation for impact points through formation of a notch on a collector ring of the sight.

Description of the Related Art

Referring to FIGS. 1*a*-1*c* and 2-4, a conventional sight includes a windage/elevation adjusting unit 012, a collector ring 001, an elevation adjusting member 024, a windage adjusting member 124, a windage/elevation adjusting leaf spring 025 and a leaf spring holder 092.

The windage/elevation adjusting unit 012 bears a windage/elevation adjusting lens. The collector ring 001 is a barrel and has a connecting end 002, a free end 003 and a periphery 004. The collector ring 001 bears collector lenses and connects to the windage/elevation adjusting unit 012 through the connecting end 002. The elevation adjusting member 024 and the windage adjusting member 124 abut the periphery 004 of the collector ring 001 respectively. The windage/elevation adjusting leaf spring 025 includes a base 026 fixed to the leaf spring holder 092 and an arm 027. The base 026 is mounted to the leaf spring holder 092, and the leaf spring holder 092 is disposed near the collector ring 001. The windage/elevation adjusting leaf spring 025 extends from the leaf spring holder 092 to the collector ring 001, and the arm 027 abuts the periphery 004 through spring force generated by deformation. As shown in FIG. 4, the arm 027 extends at an angle β from the base 026 when the arm 027 is free without deformation. When the windage/elevation adjusting leaf spring 025 is mounted to the collector ring 001, the arm 027 deforms to push the periphery 004 of the collector ring 001. As shown in FIG. 2, the force of the windage/elevation adjusting leaf spring 025 is applied to an appropriate position on the collector ring 001. Thus, the contact of the collector ring 001 with the elevation adjusting member 024 and the windage adjusting member 124 can be maintained, and the operation of the elevation adjusting member 024 and the windage adjusting member 124 is reliable.

As shown in FIG. 4, a position P on the periphery 004, in which the collector ring 001 sustains the force of the arm 027 of the windage/elevation adjusting leaf spring 025, is near the free end 003 of the collector ring 001. In other words, the contact position on the arm 027 is near where the arm 027 and the base 026 are connected. Therefore, the maximal angular displacement α1 of the windage/elevation adjusting unit 012 is limited by the contact position of the arm 027 and the collector ring 001 even if the arm 027 deforms to the maximal angle β.

BRIEF SUMMARY OF THE INVENTION

To address the shortcomings discussed, the invention provides a sight including an improved collector ring which increases the range of compensation for impact points.

The sight in accordance with an exemplary embodiment of the invention includes an adjusting module, a collector ring, a first adjusting element, and an elastic element. The collector ring includes a connecting end connected to the adjusting module, a free end opposite to the connecting end, a periphery connecting the connecting end and the free end, and a notch formed on the periphery and connected to the free end. The first adjusting element includes a first end which abuts the periphery. The elastic element extends in a direction from the free end to the connecting end and abuts the periphery. The elastic element contacts the periphery in a position between the notch and the connecting end. The first end is configured to resist an elastic force exerted by the elastic element and move the collector ring.

In another exemplary embodiment, the sight further includes a holder disposed near the free end, wherein the elastic element is disposed on the holder.

In yet another exemplary embodiment, the elastic element includes a base fixed to the holder, and an arm contacting the periphery and extending at an angle from the base.

In another exemplary embodiment, the arm includes a contact portion contacting the periphery, and the contact portion is smaller than the base in width.

In yet another exemplary embodiment, the arm includes a portion contacting the periphery, and the portion has a width greater than or equal to 3.3 mm and less than or equal to 3.9 mm.

In another exemplary embodiment, the elastic element includes a base, and an arm contacting the periphery and extending at an angle from the base.

In yet another exemplary embodiment, the arm includes a portion contacting the periphery, and the portion is smaller than the base in width.

In another exemplary embodiment, the arm includes a contact portion contacting the periphery, and the contact portion has a width greater than or equal to 3.3 mm and less than or equal to 3.9 mm.

In yet another exemplary embodiment, the elastic element includes a leaf spring.

In another exemplary embodiment, the sight further includes a second adjusting element which includes a second end abutting the periphery, wherein the second end is configured to resist the elastic force exerted by the elastic element and move the collector ring.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 5A:
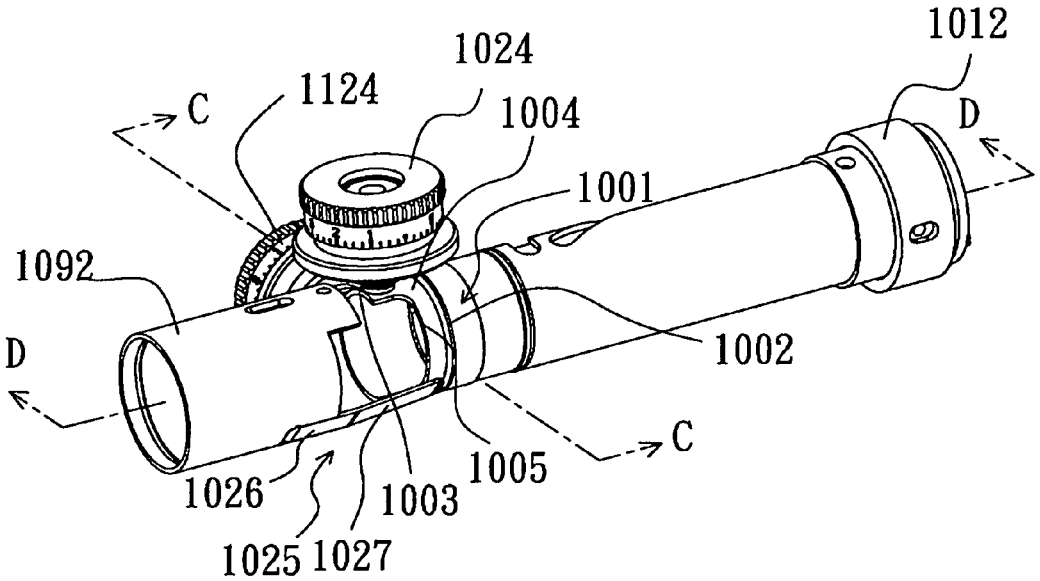
FIG. 5*a* is a perspective view of a sight of the invention.
Figure 5B:
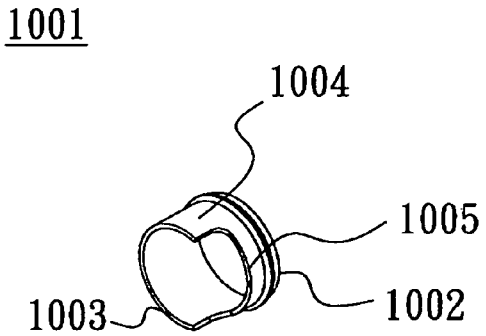
FIG. 5*b* is a perspective view of a collector ring of the sight of FIG. 5*a;*
Figure 5C:
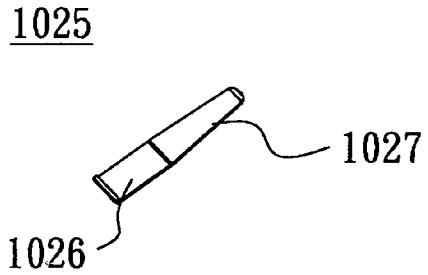
FIG. 5*c* is a perspective view of an elastic element of the sight of FIG. 5*a;*

Referring to FIGS. 5*a*-5*c*, a sight of the invention includes an adjusting module 1012, a collector ring 1001, a first adjusting element 1024, a second adjusting element 1124, an elastic element 1025 and a holder 1092.

The adjusting module 1012 bears an adjusting lens set. The collector ring 1001 is a barrel and includes a connecting end 1002, a free end 1003, a periphery 1004 and a notch 1005. The connecting end 1002 and the free end 1003 are opposite to each other, and the periphery 1004 connects the connecting end 1002 and the free end 1003. The notch 1005 is formed on the periphery 1004 and connected to the free end 1003. The collector ring 1001 connects to the adjusting module 1012 through the connecting end 1002. In this embodiment, the first adjusting element 1024 is an elevation adjusting element, and the second adjusting element 1124 is a windage adjusting element. The first adjusting element 1024 includes a first end 1021, and the second adjusting element 1124 includes a second end 1121. The first end 1021 and the second end 1121 abut an external surface of the periphery 1004. The holder 1092 is disposed near the free end 1003 of the collector ring 1001. In this embodiment, the elastic element 1025 is a leaf spring and includes a base 1026 and an arm 1027. The arm 1027 is connected to the base 1026, and the base 1026 is fixed to the holder 1092. In this embodiment, the base 1026 engages a slot of the holder 1092. The arm 1027 connects to the base 1026, and the arm 1027 extends from the base 1026 in a direction from the free end 1003 toward the connecting end 1002 and across the notch 1005 to contact the periphery 1004.

Figure 6:
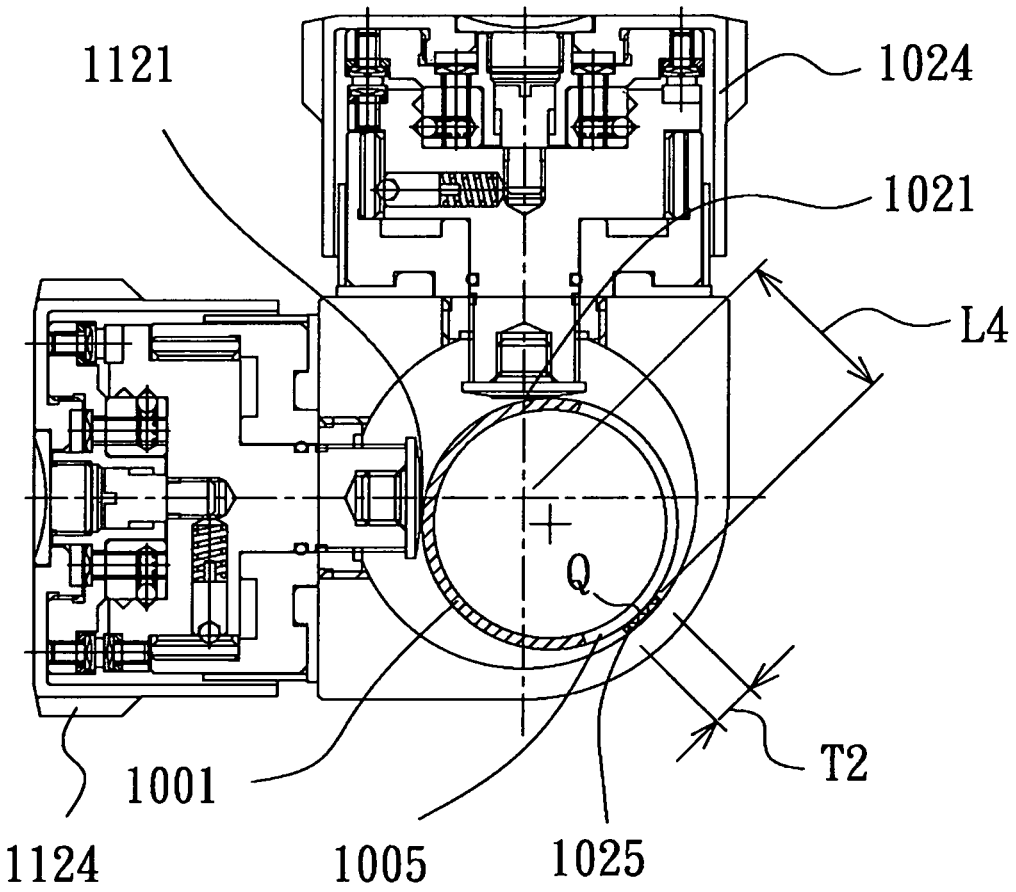
FIG. 6 is a cross section of FIG. 5*a* along a line C-C.

Referring to FIG. 6, the force of the elastic element 1025 is applied to an appropriate position on the periphery 1004, whereby the collector ring 1001 is maintained to contact the first end 1021 and the second end 1121, and the operation of the first adjusting element 1024 and the second adjusting element 1124 for compensating impact points in adjusting process is reliable.

Figure 7:
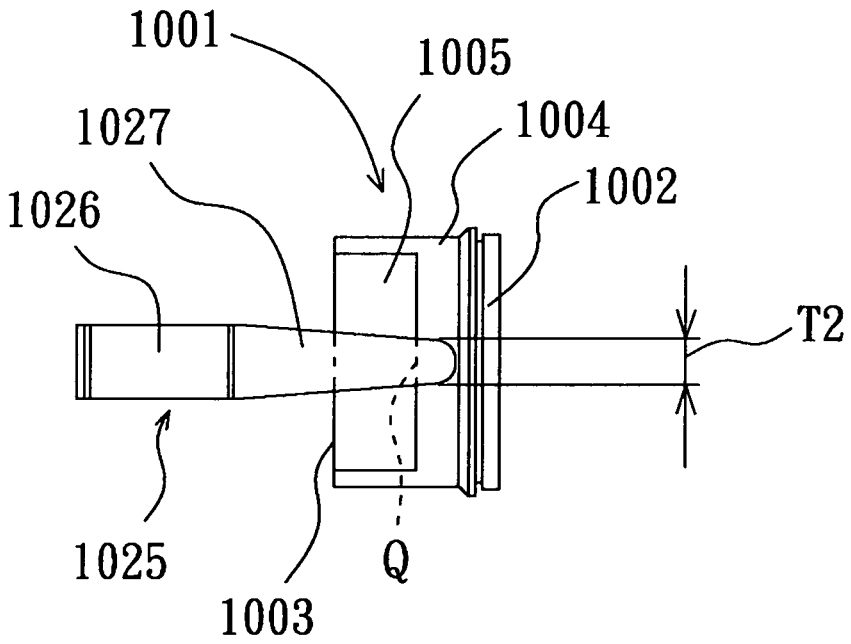
FIG. 7 depicts the elastic element contacting the collector ring of FIG. 5*a*.
Figure 8:
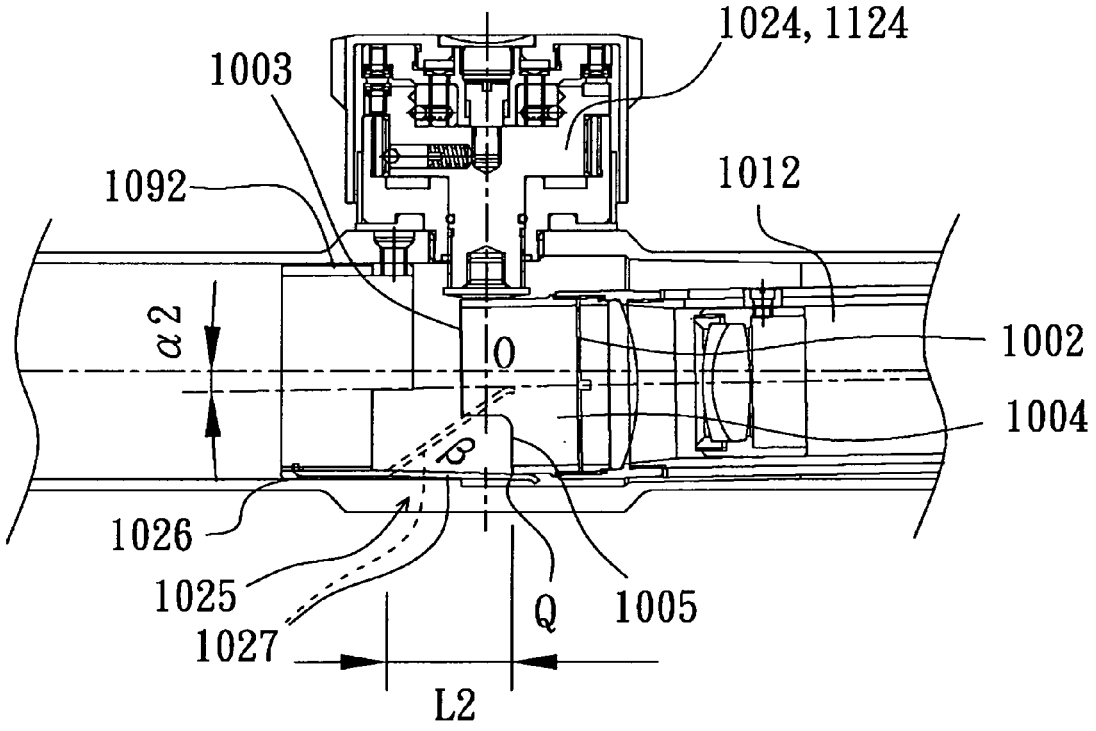
FIG. 8 is a cross section of FIG. 5*a* along a line D-D.

Referring to FIG. 7, the arm 1027 contacts the periphery 1004 at a position Q which is between the notch 1005 and the connecting end 1002. Therefore, the distance between the position Q and the connecting end 1002 is smaller than the distance between the position P and the connecting end 002 shown in FIG. 3. That is, the distance between the position Q and the location where the arm 1027 and the base 1026 are connected is greater than the distance between the position P and the location where the arm 027 and the base 026 are connected. As shown in FIG. 8, the arm 1027 extends at an angle β from the base 1026 when no force is exerted on the arm 1027. When the arm 1027 pushes the collector ring 1001 and deforms, a spring force is generated. When the arm 1027 deforms to the maximal angle β, the adjusting module 1012 correspondingly has an angular displacement α2. As the position Q is closer to the connecting end 1002 and farther from a center O (an intersection of virtual lines extending from the first end 1021 and the second end 1121) as compared with the position P shown in FIG. 3, the angular displacement α2 is larger than the angular displacement α1 shown in FIG. 4.

Figure 1A:
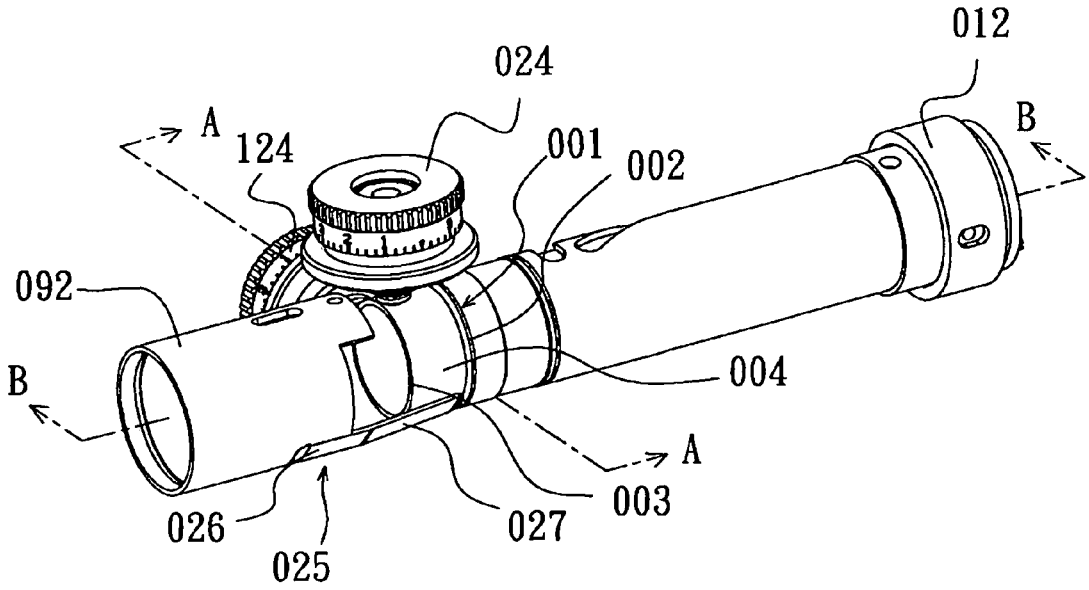
Fig. 1a (PRIOR ART)
FIG. 1*a* is a perspective view of a conventional sight.
Figure 1B:
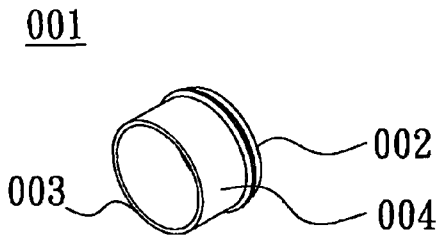
Fig. 1b (PRIOR ART)
FIG. 1*b* is a perspective view of a collector ring of the sight of FIG. 1*a;*
Figure 1C:
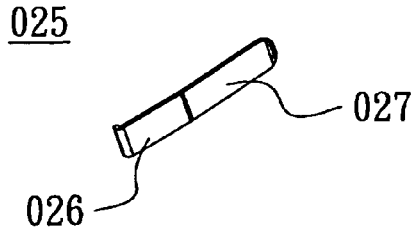
Fig. 1c (PRIOR ART)
FIG. 1*c* is a perspective view of an elastic element of the sight of FIG. 1*a;*
Figure 2:
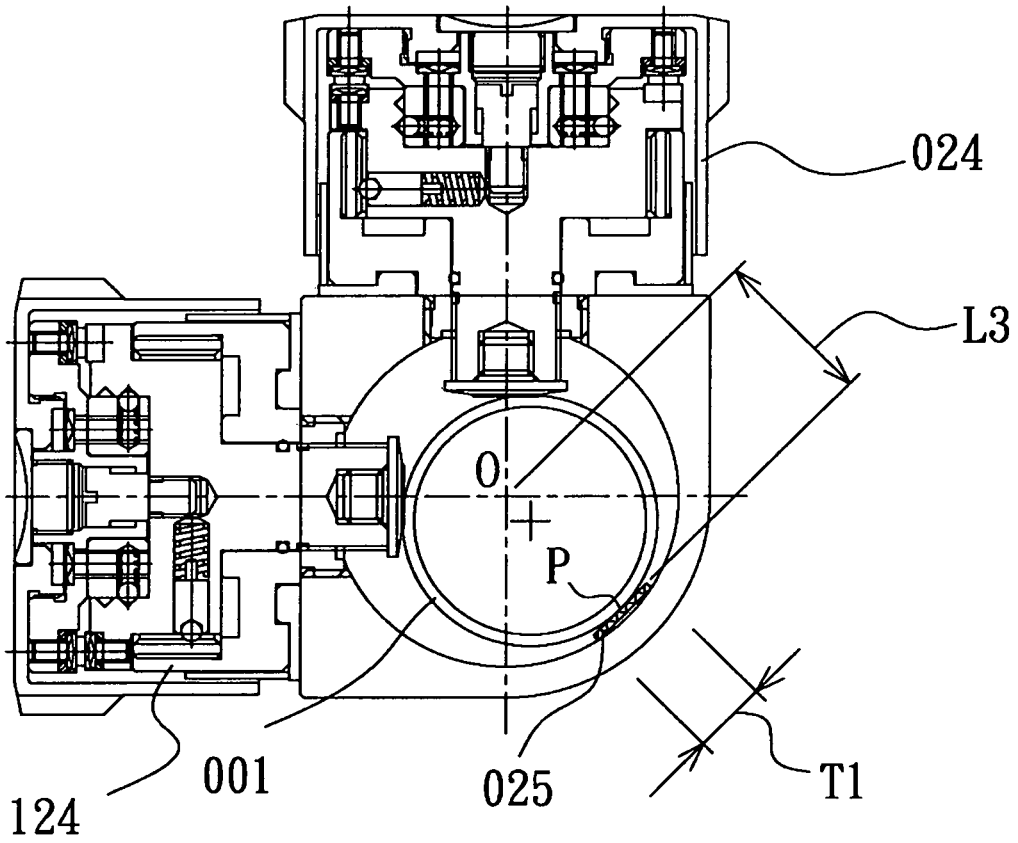
Fig. 2 (PRIOR ART)
FIG. 2 is a cross section of FIG. 1*a* along a line A-A.
Figure 3:
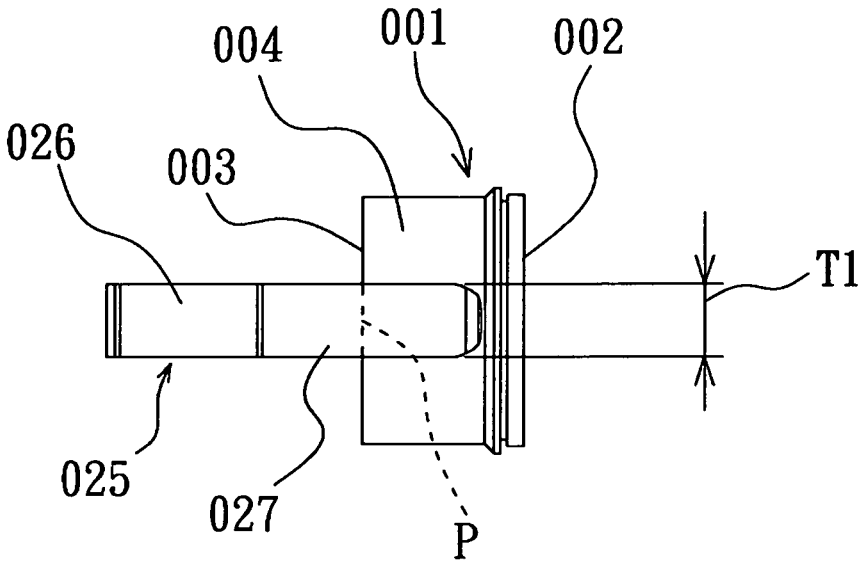
Fig. 3 (PRIOR ART)
FIG. 3 depicts the elastic element contacting the collector ring of FIG. 1*a;*

Referring to FIGS. 5*c* and 7, the base 1026 of the elastic element 1025 is a rectangular metal strip, and the arm 1027 is also a metal strip connected to the base 1026. The arm 1027 is integrated with the base 1026. In this embodiment, the width of the arm 1027 gradually increases from the front end of the arm 1027 to where the arm 1027 and the base 1026 are connected, and the arm 027 of the windage/elevation adjusting leaf spring 025 as shown in FIGS. 1*c* and 3 has a uniform width. Therefore, the arm 1027 of the invention has a width smaller than the arm 027 of the conventional sight, and the contact width of the arm 1027 and the collector ring 1001 is smaller than the width of the arm 027. Referring to FIG. 7, the width T2 of the arm 1027 in the position Q has a range of 3.3 mm T2≤3.9 mm. Referring to FIG. 3, the width T1 of the arm 027 in the position P has a range of 5.5 mm≤T1≤6.5 mm. The width T2 is about 60% of the width T1.

Figure 4:
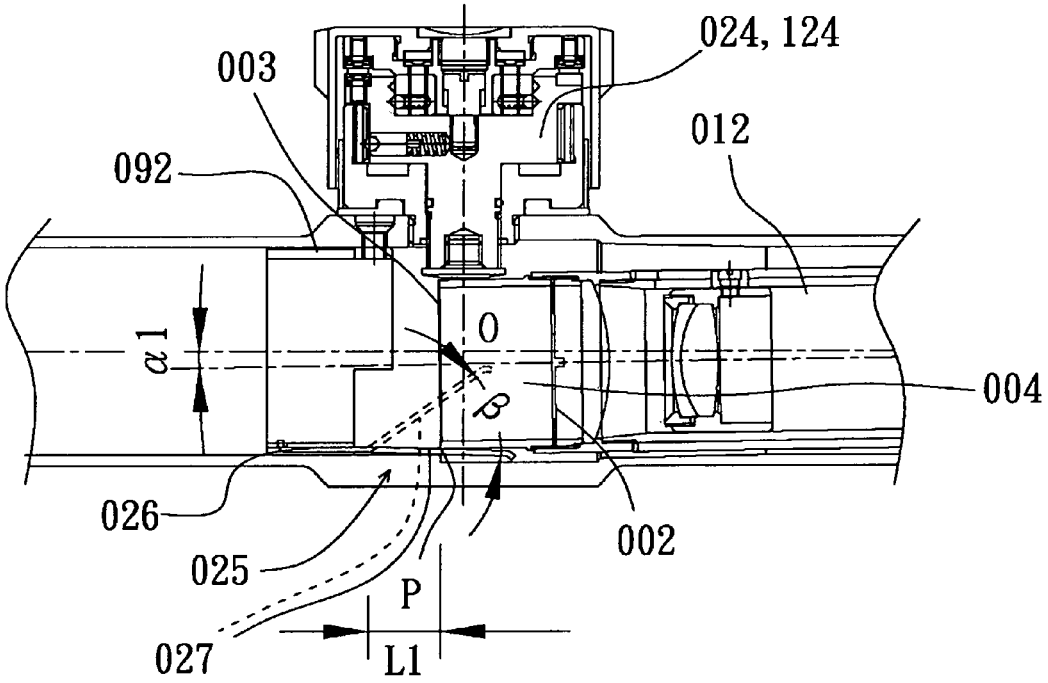
Fig. 4 (PRIOR ART)
FIG. 4 is a cross section of FIG. 1*a* along a line B-B.

In comparison between the sight of the invention of FIG. 8 and the conventional sight of FIG. 4, the maximal angular displacement α2 of the elastic element 1025 is always larger than the angular displacement α1 of the windage/elevation adjusting leaf spring 025 when the elastic element 1025 and the windage/elevation adjusting leaf spring 025 deform to the maximal angle β. That means the sight of the invention provides a larger compensation range for impact points than the conventional sight.

The sight of the invention has a structure which enables the elastic element 1025 to provide a larger spring force and more durability than the conventional windage/elevation adjusting leaf spring 025. Referring to FIGS. 4 and 8, when the elastic element 1025 and the windage/elevation adjusting leaf spring 025 have the same maximal deformation (i.e. the maximal angle β), the length L2 of the force arm of the elastic element 1025 is always larger than the length L1 of the force arm of the windage/elevation adjusting leaf spring 025. Therefore, the elastic element 1025 of the invention has a better durability to avoid elastic fatigue.

Since the distance between the position Q and the location where the arm 1027 and the base 1026 are connected is greater than the distance between the position P and the location where the arm 027 and the base 026 are connected, the spring force of the elastic element 1025 applied to the adjusting module 1012 is larger than the spring force of the windage/elevation adjusting leaf spring 025 applied to the windage/elevation adjusting unit 012. Thus, rotation of the adjusting module 1012 can be effectively prevented and the stability of the adjusting module 1012 can be improved. As compared with the elastic element 1025, the windage/elevation adjusting leaf spring 025 has a shorter distance between the position P and the location where the arm 027 and the base 026 are connected. Therefore, the windage/elevation adjusting leaf spring 025 is susceptible to fatigue and fails to provide enough spring force to push the windage/elevation adjusting unit 012.

Since the width of the arm 1027 in the position Q is smaller than the width of the arm 027 in the position P, the elastic element 1025 contacts the adjusting element 1012 in a smaller width. As compared with the position P, the position Q is closer to the connecting end 1002 and farther from the center O (an intersection of virtual lines extending from the first end 1021 and the second end 1121). A larger range of compensation for impact points is provided.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A sight, comprising:

an adjusting module bearing an adjusting lens set;

a collector ring comprising a connecting end connected to the adjusting module, a free end opposite to the connecting end, a periphery connecting the connecting end and the free end, and a notch formed on the periphery and connected to the free end;

a first adjusting element comprising a first end which abuts the periphery;

an elastic element extending in a direction from the free end to the connecting end and abutting the periphery, wherein the elastic element contacts the periphery in a position between the notch and the connecting end, and the first end is configured to resist an elastic force exerted by the elastic element and move the collector ring.

2. The sight as claimed in claim 1 further comprising a holder disposed near the free end, wherein the elastic element is disposed on the holder.

3. The sight as claimed in claim 2, wherein the elastic element comprises a base fixed to the holder, and an arm contacting the periphery and extending at an angle from the base.

4. The sight as claimed in claim 3, wherein the arm comprises a contact portion contacting the periphery, and the contact portion is smaller than the base in width.

5. The sight as claimed in claim 3, wherein the arm comprises a portion contacting the periphery, and the portion has a width greater than or equal to 3.3 mm and less than or equal to 3.9 mm.

6. The sight as claimed in claim 1, wherein the elastic element comprises a base, and an arm contacting the periphery and extending at an angle from the base.

7. The sight as claimed in claim 6, wherein the arm comprises a contact portion contacting the periphery, and the contact portion is smaller than the base in width.

8. The sight as claimed in claim 6, wherein the arm comprises a portion contacting the periphery, and the portion has a width greater than or equal to 3.3 mm and less than or equal to 3.9 mm.

9. The sight as claimed in claim 1, wherein the elastic element comprises a leaf spring.

10. The sight as claimed in claim 1, further comprising a second adjusting element which comprises a second end abutting the periphery, wherein the second end is configured to resist the elastic force exerted by the elastic element and move the collector ring.

11. The sight as claimed in claim 1, wherein the elastic element contacts the collector ring directly.

* * * * *